US010634342B2

(12) United States Patent
Heilskov

(10) Patent No.: US 10,634,342 B2
(45) Date of Patent: Apr. 28, 2020

(54) MODULAR OCTAGON BURNER

(71) Applicant: SUKUP MANUFACTURING CO., Sheffield, IA (US)

(72) Inventor: Casey Scott Heilskov, Hampton, IA (US)

(73) Assignee: SUKUP MANUFACTURING CO., Sheffield, IA (US)

( * ) Notice: Subject to any disclaimer, the term of this patent is extended or adjusted under 35 U.S.C. 154(b) by 128 days.

(21) Appl. No.: 16/001,727

(22) Filed: Jun. 6, 2018

(65) Prior Publication Data

US 2018/0347809 A1 Dec. 6, 2018

Related U.S. Application Data

(60) Provisional application No. 62/515,573, filed on Jun. 6, 2017.

(51) Int. Cl.

| | |
|---|---|
| ***F23D 14/14*** | (2006.01) |
| ***F26B 23/02*** | (2006.01) |
| ***F23D 14/84*** | (2006.01) |

(52) U.S. Cl.

CPC ..... *F23D 14/14* (2013.01); *F23D 14/84* (2013.01); *F26B 23/02* (2013.01)

(58) Field of Classification Search

CPC ..... F23D 14/84
USPC ..... 431/328, 351, 354
See application file for complete search history.

(56) References Cited

U.S. PATENT DOCUMENTS

| | | | | |
|---|---|---|---|---|
| 3,297,259 A | | 1/1967 | Maxon, Jr. et al. | |
| 3,625,495 A | * | 12/1971 | Harter | F23D 14/34 432/223 |
| 4,753,721 A | * | 6/1988 | McDaniel | C10G 49/12 208/113 |
| 5,658,139 A | * | 8/1997 | Flanagan | F23D 14/26 431/328 |
| 6,921,261 B2 | | 7/2005 | Perry | |
| 7,481,650 B2 | | 1/2009 | Mosiewicz et al. | |

* cited by examiner

*Primary Examiner* — Avinash A Savani
(74) *Attorney, Agent, or Firm* — Zarley Law Firm, P.L.C.

(57) ABSTRACT

A modular octagon burner has a plurality of fuel manifold modules. Each of the fuel manifold modules have a mounting flange on each end that angles inwardly to permit the fuel manifold modules to form an octagon when connected together. Inner and outer mixing plates are connected to the fuel manifold modules and to one another to form a combustion region.

14 Claims, 6 Drawing Sheets

MODULAR OCTAGON BURNER

CROSS REFERENCE TO RELATED APPLICATION

This application claims the benefit of U.S. Provisional Application No. 62/515,573 filed Jun. 6, 2017.

BACKGROUND OF THE INVENTION

The present invention is directed to a burner for heating propelled air for various drying processes. In particular, the invention is directed to a burner having a plurality of modules that are connected to form a round or octagon burner.

Burners for heating propelled air are well-known in the art. Typically, existing burners are connected together to form a straight line. During the production process of existing burners, welding is used, and the burners have a limited life as they have low oxidation resistance. The welding is time consuming and costly. Further, existing burners are difficult to assemble and are not well-suited for round housings. Accordingly, a need exists in the art for a burner that addresses these deficiencies.

An objective of the present invention is to form a modular octagon burner that when assembled form an octagon.

Another objective of the present invention is to provide a modular octagon burner that is easy to assemble and suited for round housings.

These and other objectives will be apparent to one having ordinary skill in the art based upon the following written description, drawings, and claims.

SUMMARY OF THE INVENTION

A modular octagon burner includes a plurality of fuel manifold modules that when connected together form an octagon. Preferably, each module is comprised of a hollow tube having a tube axis. The tube has a top face through which gas ports extend.

Each end of the modules have mounting flanges that angle inwardly in relation to the tube axis from an outer edge to an inner edge. Connected to the modules and to one another, are inner and outer mixing plates that form a combustion region. The inner and outer plates have flanges that extend outwardly from first and second side edges. The flanges are adapted to engage and connect to the flanges on adjacent inner and outer mixing plates.

DETAILED DESCRIPTION

Figure 1:
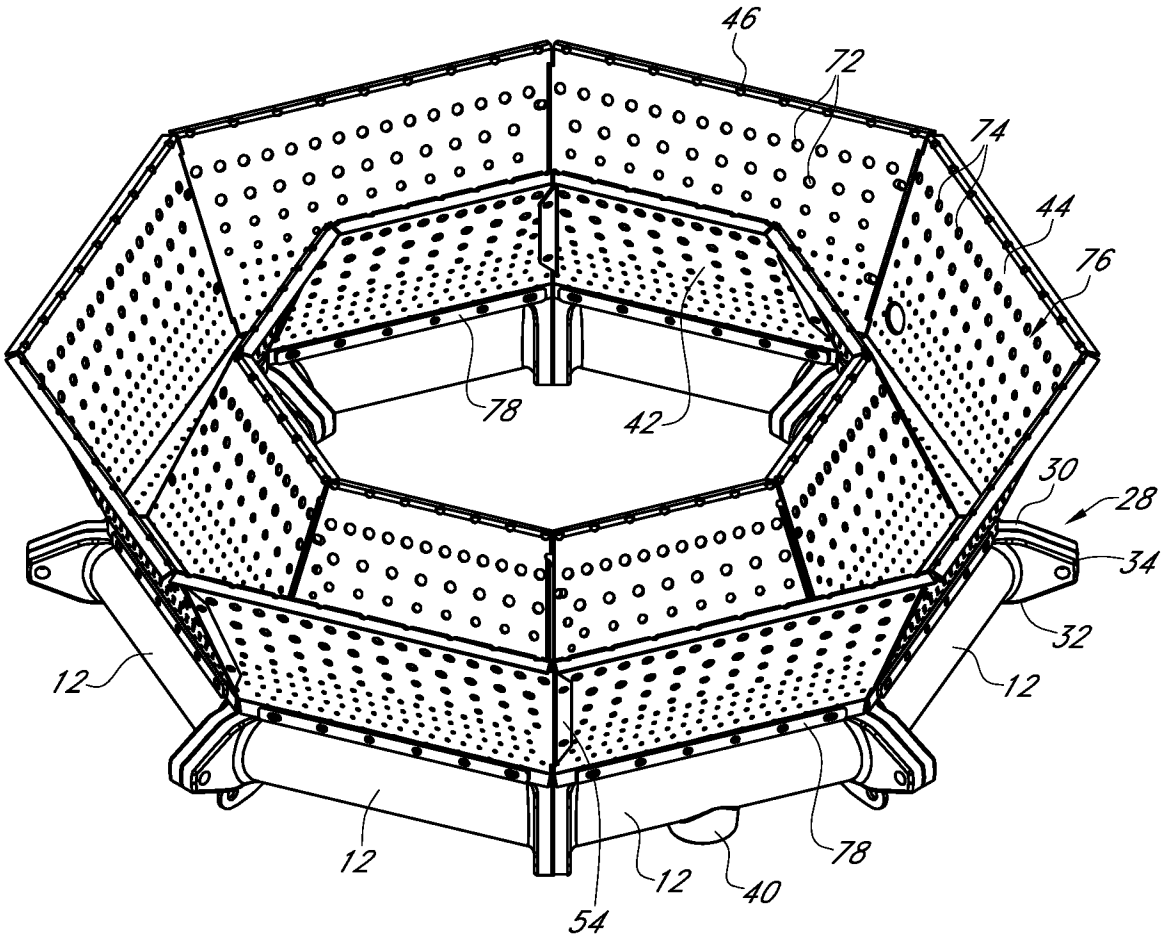
FIG. 1 is a perspective view of a modular octagon burner.
Figure 2:
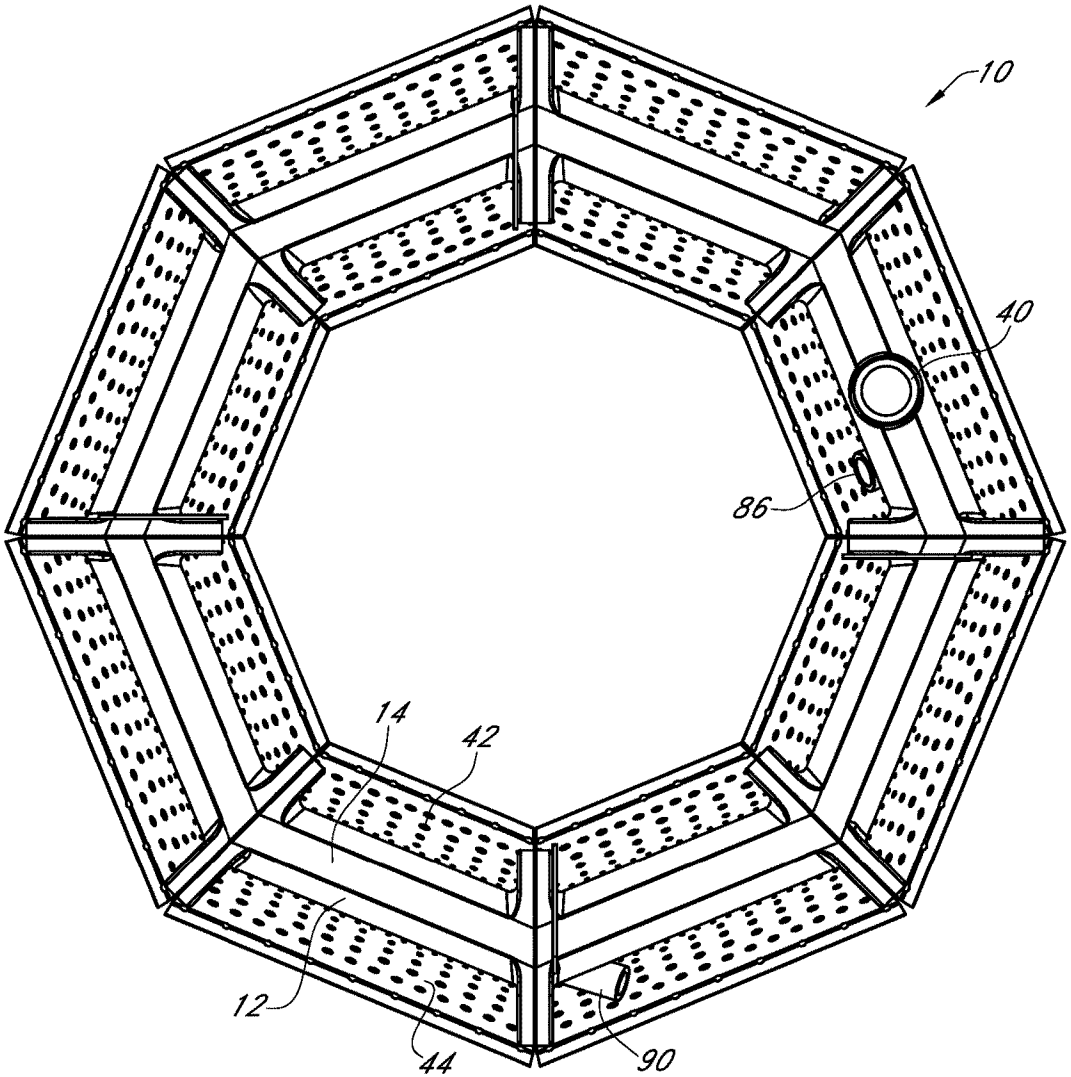
FIG. 2 is a top plan view of a modular octagon burner.

Referring to the Figures, a modular octagon burner 10 has a plurality of fuel manifold modules 12. Each fuel manifold module 12 has an elongated hollow fuel tube 14 having a tube axis 16. The tube 14 has an elongated top face 18 as shown in FIG. 2. The top face 18 has a top surface 20 and a pair of side surfaces 22. The top surface 20 has a plurality of spaced gas ports 24 that extend from the top surface 20, through the top face 18 and into the tube 14. The side surfaces 22 of the top face 18 have a plurality of mounting holes 26.

Each fuel manifold module 12 has a mounting flange 28 at each end. The mounting flanges 28 are of any size and shape and in the example shown have a top edge 30, a bottom edge 32, an outer edge 34, and an inner edge 36. Also, the mounting flanges 28 are angled in relation to the tube axis 16. More specifically, the mounting flanges 28 are angled inwardly from the outer edge 34 to the inner edge 36 such that the distance between the two outer edges 34 is greater than the distance between the two inner edges 36. While the flanges 28 are of any angle in relation to the tube 14, preferred is an angle of 22.5° between the tube axis 16 and the flange 28 from the tube 14 to the inner end. An angle of 22.5° allows eight fuel manifold modules 12 to connect and form an octagon shape. In another example, an angle of 30° between the tube axis 16 and the flange 28 is used which results in a hexagon shape. Adjacent the inner 36 and outer 34 edges, each flange has connecting holes 38 that are positioned to align with connecting holes 38 on a mounting flange 28 of an adjacent fuel manifold module 12.

One of the plurality of fuel manifold modules 12 has a threaded inlet port 40. The threaded inlet port 40 is configured and positioned to connect to a gas train (not shown) that supplies fuel/gas to the hollow tubes 14 of the plurality of fuel manifold modules 12.

Figure 3:
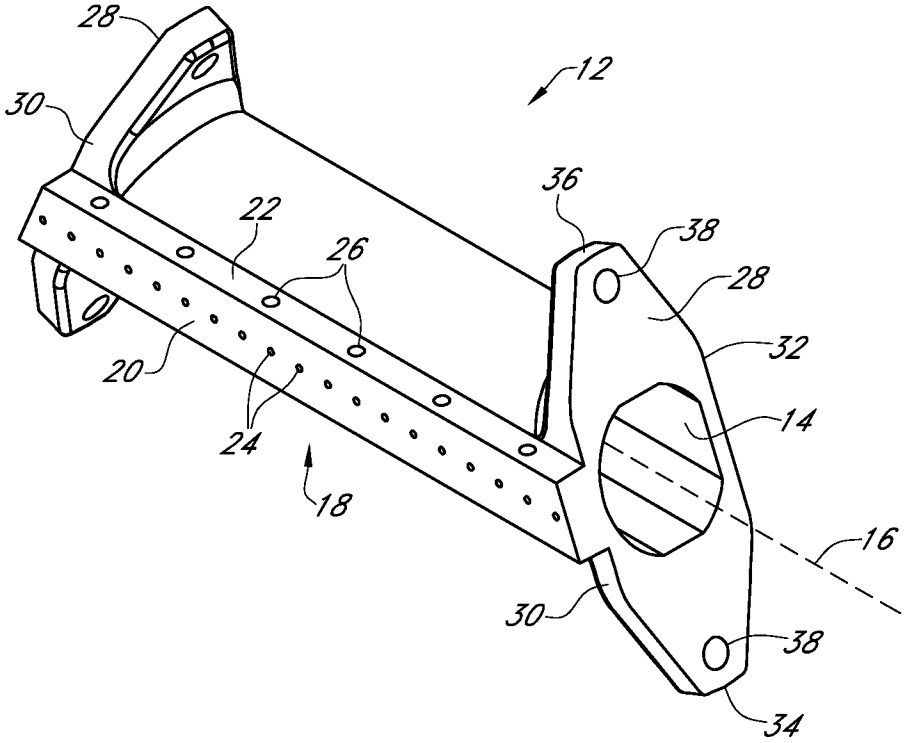
FIG. 3 is a perspective view of a fuel manifold module.
Figure 4:
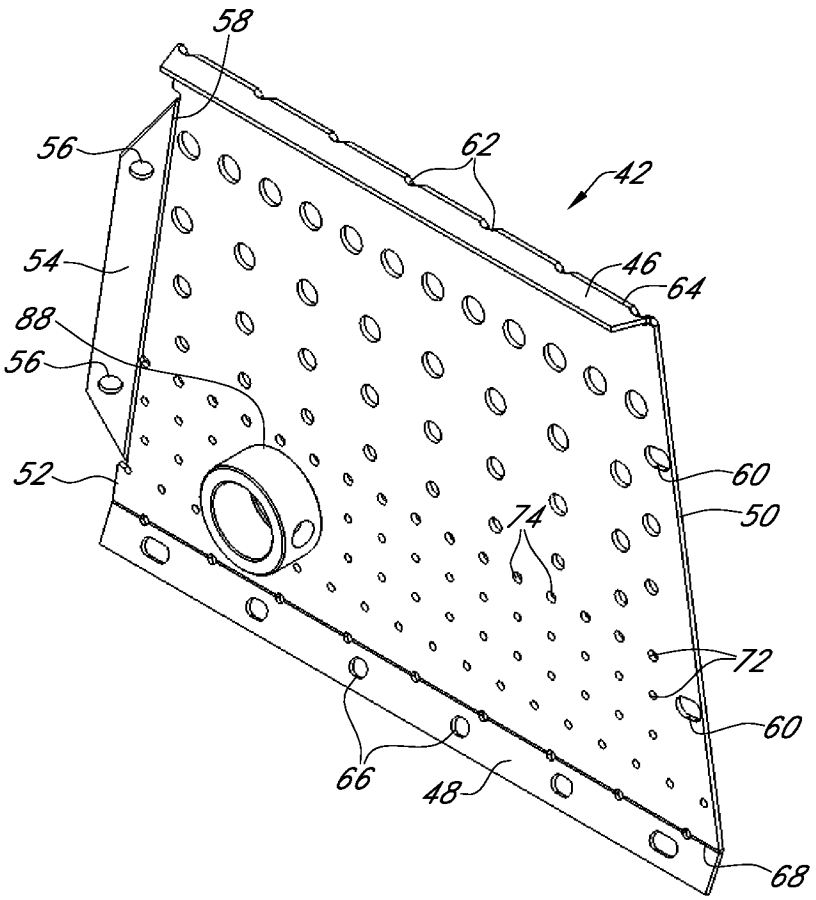
FIG. 4 is a perspective view of a mixing plate.
Figure 5:
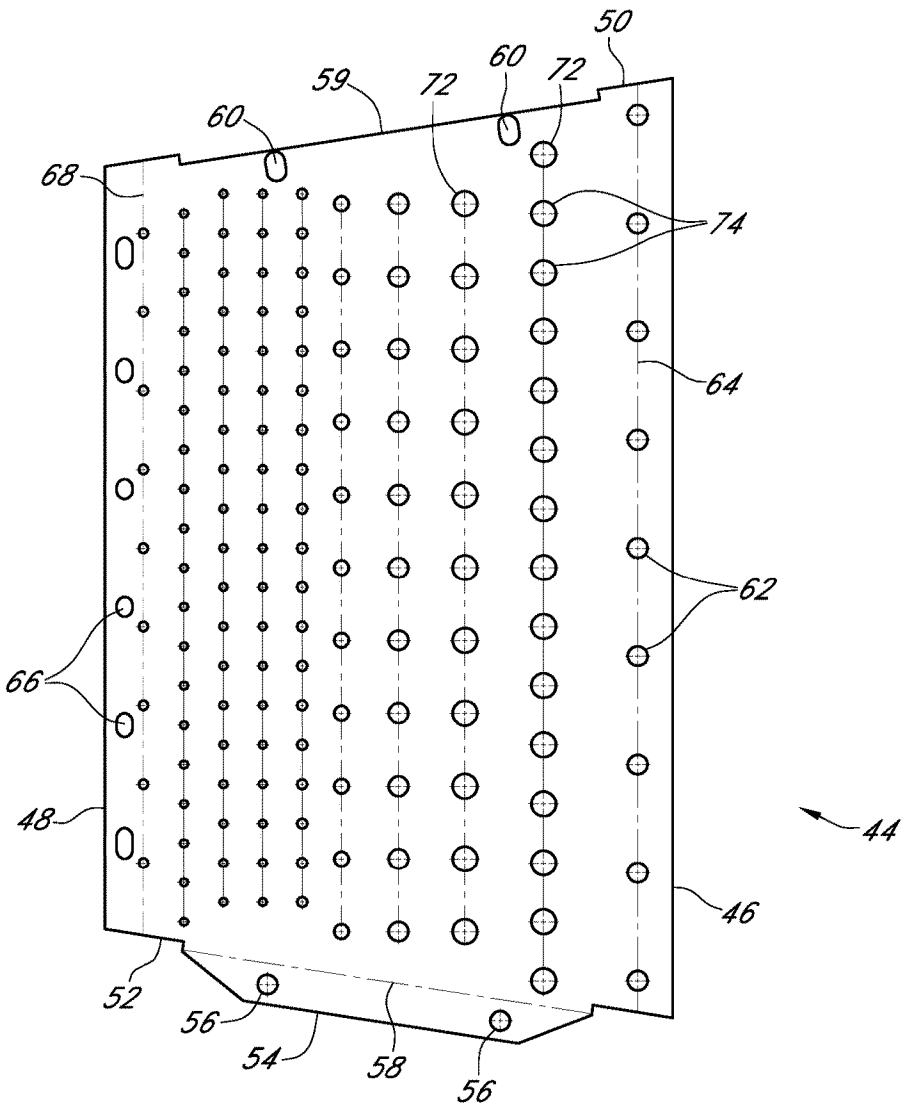
FIG. 5 is a side view of a mixing plate.
Figure 6:
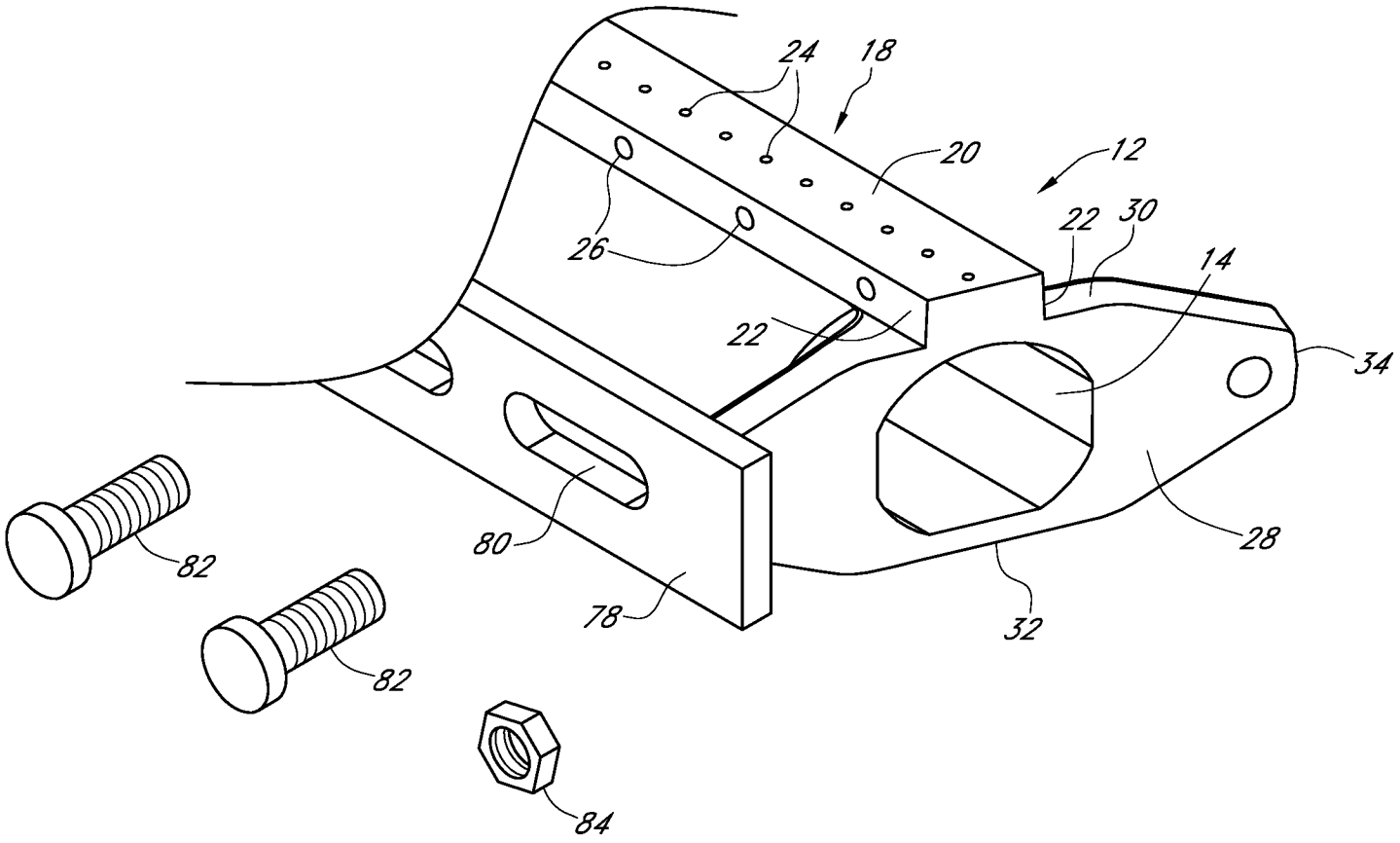
FIG. 6 is a partial perspective view of a fuel manifold module.

Connected to each fuel manifold module 12 is an inner 42 and an outer 44 mixing plate or diffuser. The mixing plates 42 and 44 are of any size, shape, and structure and preferably are made of stainless steel. In the example in FIG. 3 the mixing plates 42 and 44 have a top edge 46, a bottom edge 48, a first side edge 50 and a second side edge 52. The second edge 52 has an outwardly extending flange 54. The flange 54 has a pair of apertures 56 and is formed to be bent along fold line 58. The first side edge 50 has a cut-out 59 having a length approximately the same as the length of the flange 54. The first side edge 50 also has a pair of apertures 60 that are positioned to align with apertures 56 on a flange 54 of an adjacent mixing plate 42 or 44.

The top edge 46 has a plurality of spaced apertures 62 and is bent along a fold line 64. Preferably, fold line 64 intersects the apertures 62. The bottom edge 48 has a plurality of spaced slots 66 and is bent along fold line 68. The plates 42 and 44 have a plurality of rows 72 that include spaced apertures 74. Preferably, rows 72 that are closer to the bottom edge 48 have apertures 74 with a smaller diameter and closer spacing than the rows that are closer to the top edge 46.

The side edges 50 and 52 of the inner mixing plate 42 angle inwardly from the bottom edge 48 toward the top edge 46. For the outer mixing plate 44, the side edges 50 and 52 angle outwardly from the bottom edge 48 to the top edge 46.

The inner 42 and outer 44 mixing plates are connected to the fuel manifold modules 12 to form a combustion region 76 where fuel and air are mixed together at a desired ratio for efficient combustion. More specifically, the bottom edge 48 of mixing plates 42 and 44 are bent along fold line 64 so that each plate 42 and 44 are angled away from the module 12. A washer plate 78 having spaced slots 80 is positioned on the side surfaces 22 of the top face member 20 so that slots 80 align with mounting holes 26. The slots 66 on the bottom edge 48 of mixing plates 42 and 44 are then aligned with slots 80 and a bolt 82 is inserted through slots 66 and 80 and is matingly received within holes 26. Once the bolt is tightened, the bottom edge 48 engages the washer plate 78 and the washer plate 78 engages the side surfaces 22 of the top face member 20.

Adjacent plates 42 and 44 are connected by laying a flange 54 of a second side edge 52 of a first plate 42 and 44 over the first side edge 50 of a second, adjacent plate 42 and 44. The flange 54 is bent along flange fold line 58 so that flange 54 of the first plate 42 and 44 engages the first side edge 50 of the second adjacent plate 42 and 40 and flange apertures 56 align with the first side edge apertures 60 bolts 82 are inserted through apertures 56 and 60 and tightened with a nut 84. This process is repeated until all plates 42 and 44 are connected to form a ring. Finally, the top edge 46 of plates 42 and 46 are folded outwardly away from modules 12 along fold line 64.

On one of the inner mixing plates 42, adjacent the inlet port 40, is an ignitor 86. The ignitor 86 is of any size, shape and structure. In one example, the ignitor 86 is surrounded by a collar 88 connected to an inner plate 42 preferably by welding. Extending outwardly from an outer mixing plate 44 and in communication with the combustion chamber is a flame sensor pipe 90. Preferably the flame sensor pipe is positioned approximately 90 degrees from the ignitor 86.

In operation, the burner 10 is used to heat process air used for drying processes. Typically, the burner 10 is positioned downstream from an axial or inline centrifugal fan (not shown). The burner 10 is particularly suited for these types of fans as they have round housings. The fans propel air past the burner 10, some of which is forced through the rows 72 of spaced apertures 74 on the mixing plates 42 and 44. The air pushed through the mixing plates 42 and 44 mixes with fuel that flows from the manifolds 12 through the gas ports 24. The fuel-air mixture is ignited by an electric arc of the ignitor and continues to burn as it is fed fuel and air. The air passing through the housing of the fan is heated by the combustion process.

Thus, a burner has been disclosed, that at the very least, meets all the stated objectives. The preferred burner is designed in cast aluminum modules that are bolted together in an octagon shape. The mixing plates, made of stainless steel, are bolted to the manifolds and bolted to each other. The connection by bolts allows for easy assembly, and the design is well suited for round housings. Manufacturing costs and time are substantially reduced because the production process does not require welding the modules. The burner has the added benefit of resisting oxidation as compared to a steel burner.

From the above discussion and accompanying figures and claims it will be appreciated that the burner 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A modular octagon burner, comprising:

a plurality of fuel manifold modules including elongated fuel tubes;

the elongated fuel tubes having an axis that extends through the entire length of each elongated fuel tube; and mounting flanges protruding at each end of the fuel manifold modules;

the mounting flanges each having a top edge, a bottom edge, an outer edge, and an inner edge, wherein the mounting flanges are angled inwardly from an outer edge to an inner edge in relation to the tube axis such that a distance between the outer edges of the mounting flanges on each fuel manifold module is greater than a distance between the inner edges on each fuel manifold module; and the mounting flanges connecting to adjacent fuel manifold modules to form the modular octagon burner.

2. The burner of claim 1 wherein the elongated fuel tubes have a top face that includes a top surface and side surfaces.

3. The burner of claim 2 wherein the top face has a plurality of gas ports that extend from the top surface, through the top face, and into the fuel tube.

4. The burner assembly of claim 1 wherein one of the plurality of fuel manifold modules have an inlet port.

5. The burner assembly of claim 1 wherein inner and outer mixing plates are connected to the plurality of fuel manifold modules.

6. The burner assembly of claim 5 wherein of the inner mixing plates has an ignitor.

7. The burner assembly of claim 5 wherein the inner and outer mixing plates are bent along a fold line away from the fuel manifold module.

8. The burner assembly of claim 5 wherein the inner and outer mixing plates have flanges that extend outwardly from a first and a second side edge, the flanges adapted to engage and connect to the flanges on an adjacent inner and outer mixing plate.

9. The burner assembly of claim 5 further comprising at least one of the inner mixing plates having an ignitor.

10. The burner assembly of claim 5 further comprising a collar surrounding the ignitor and connected to the at least one inner mixing plate.

11. The burner assembly of claim 5 further comprising at least one inner mixing plate having a top edge and a bottom edge, wherein the top edge has a plurality of spaced apart apertures and the bottom edge has a plurality of spaced slots.

12. The burner assembly of claim 5 further comprising at least one inner mixing plate having a plurality of rows having spaced apertures, wherein the spacing between the spaced apertures is smaller closer to a bottom edge than a top edge of the at least one inner mixing plate.

13. A modular burner, comprising:

a plurality of fuel manifold modules including elongated fuel tubes;

the elongated fuel tubes having an axis that extends through the entire length of each elongated fuel tube; mounting flanges protruding at each end of the fuel manifold modules;

the mounting flanges each having a top edge, a bottom edge, an outer edge, and an inner edge, wherein the mounting flanges are angled inwardly from an outer edge to an inner edge in relation to the tube axis such that a distance between the outer edges of the mounting flanges on each fuel manifold module is greater than a distance between the inner edges on each fuel manifold module; and the mounting flanges connecting to adjacent fuel manifold modules to form the modular burner, wherein the modular burner has a generally round shape.

14. A modular burner, comprising:

a plurality of fuel manifold modules including elongated fuel tubes;

the elongated fuel tubes having an axis that extends through the entire length of each elongated fuel tube; mounting flanges protruding at each end of the fuel manifold modules;

the mounting flanges each having a top edge, a bottom edge, an outer edge, and an inner edge, wherein the mounting flanges are angled inwardly from an outer edge to an inner edge in relation to the tube axis such that a distance between the outer edges of the mounting flanges on each fuel manifold module is greater than a distance between the inner edges on each fuel manifold module; and the mounting flanges connecting to adjacent fuel manifold modules to form the modular burner, wherein the modular burner has a ring shape.

* * * * *